US005850820A

United States Patent [19]

Tsutsumi et al.

[11] Patent Number: 5,850,820

[45] **Date of Patent: *Dec. 22, 1998**

[54] EVAPORATIVE FUEL CONTROL SYSTEM FOR INTERNAL COMBUSTION ENGINES

[75] Inventors: Kojiro Tsutsumi; Shigeto Kashiwabara; Yasunari Seki; Sachito Fujimoto, all of Wako, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 771,255

[22] Filed: Dec. 20, 1996

[30] Foreign Application Priority Data

Dec. 22, 1995 [JP] Japan ..... 7-349430

[51] Int. Cl.[6] ..... F02M 37/04

[52] U.S. Cl. ..... 123/520; 123/357

[58] Field of Search ..... 123/520, 521, 123/518, 519, 516, 357

[56] References Cited

U.S. PATENT DOCUMENTS

| | | | |
|---|---|---|---|
| 4,961,412 | 10/1990 | Furuyama | 123/357 |
| 5,445,132 | 8/1995 | Isobe | 123/520 |
| 5,445,133 | 8/1995 | Nemoto | 123/520 |
| 5,476,081 | 12/1995 | Okawa | 123/520 |
| 5,535,719 | 7/1996 | Morikawa | 123/520 |
| 5,572,980 | 11/1996 | Nakagawa | 123/520 |

FOREIGN PATENT DOCUMENTS

| | | |
|---|---|---|
| 62-20669 | 1/1987 | Japan . |
| 7-27024 | 1/1995 | Japan . |

*Primary Examiner*—Carl S. Miller

*Attorney, Agent, or Firm*—Nikaido Marmelstein Murray & Oram, LLP

[57] ABSTRACT

An evaporative fuel control system for an internal combustion engine having a throttle valve arranged in the intake system. A canister adsorbs evaporative fuel generated in the fuel tank. A purging passage extends between the canister and the intake system, for purging evaporative fuel into the intake system at a location downstream of the throttle valve, and a purge control valve is arranged across the purging passage, for controlling the flow rate of evaporative fuel supplied to the intake system through the purging passage. When the engine is in a predetermined operating condition, the flow rate of evaporative fuel supplied to the engine is changed by controlling the purge control valve, then the degree of influence of the evaporative fuel on an air-fuel ratio of a mixture supplied to the engine is detected before and after the changing of the flow rate of the evaporative fuel, and an operating error of the purge control valve is determined based on the detected degree of influence.

13 Claims, 9 Drawing Sheets

EVAPORATIVE FUEL CONTROL SYSTEM FOR INTERNAL COMBUSTION ENGINES

BACKGROUND OF THE INVENTION

1. Field of the Invention

This invention relates to an evaporative fuel control system for internal combustion engines, which temporarily stores evaporative fuel generated in the fuel tank, and supplies the evaporative fuel into the intake system of the engine by controlling the amount thereof according to operating conditions of the engine.

2. Prior Art

Conventionally, an evaporative fuel control system for internal combustion engines is known, for example, from Japanese Laid-Open Patent Publication (Kokai) No. 62-20669, which temporarily stores evaporative fuel generated in the fuel tank in a canister, and purges the evaporative fuel through a purging passage arranged in the intake system of the engine and opening into the intake system at a location downstream of a throttle valve arranged therein.

In the known evaporative fuel processing system, the flow rate of evaporative fuel is controlled by a purge control valve arranged in the purging passage. However, the purge control valve has an operating error due to variations in characteristics between individual purge control valves used such that the actual flow rate of evaporative fuel being purged deviates from a desired value even if a control signal for driving the purge control valve commands exactly the desired value. To eliminate such an inconvenience, an evaporative fuel control system has been proposed, for example, by Japanese Laid-Open Patent Publication (Kokai) No. 7-27024, which calculates a control amount by which the air-fuel ratio of an air-fuel mixture supplied to an internal combustion engine is to be controlled, according to an output from an oxygen concentration sensor arranged in the exhaust system of the engine, and measures the operating error of the purge control valve, based on a rate of change in the calculated control amount when the engine operating condition has shifted from an idling condition to a non-idling condition.

According to this known control system, however, the control amount for the air-fuel ratio is calculated in different operating conditions of the engine, and therefore the rate of change in the control amount is influenced by factors other than the purging of evaporative fuel, which results in degraded accuracy of the measured operating error of the purge control valve.

SUMMARY OF THE INVENTION

It is the object of the invention to provide an evaporative fuel control system for internal combustion engines, which is capable of measuring an operating error of the purge control valve with high accuracy, to thereby control an amount of evaporative fuel to be supplied to the engine.

To attain the above object, the present invention provides an evaporative fuel control system for an internal combustion engine having an intake system, a throttle valve arranged in the intake system, and a fuel tank, comprising:

- a canister for adsorbing evaporative fuel generated in the fuel tank;
- a purging passage extending between the canister and the intake system, for purging evaporative fuel into the intake system at a location downstream of the throttle valve;
- a purge control valve arranged across the purging passage, for controlling a flow rate of evaporative fuel supplied to the intake system through the purging passage; and
- operating error-determining means operable when the engine is in a predetermined operating condition, for changing the flow rate of evaporative fuel supplied to the engine by controlling the purge control valve, detecting a degree of influence of the evaporative fuel on an air-fuel ratio of a mixture supplied to the engine, before and after the changing of the flow rate of the evaporative fuel, and determining an operating error of the purge control valve, based on the detected degree of influence.

Preferably, the evaporative fuel control system includes correcting means for correcting a control amount of the purge control valve according to the operating error determined by the operating error-determining means.

More preferably, the engine has an exhaust system, and the operating error-determining means includes exhaust gas component concentration-detecting means arranged in the exhaust system, and air-fuel ratio control amount-calculating means for calculating an air-fuel ratio control amount for controlling the air-fuel ratio of the mixture in a feedback manner responsive to an output from the exhaust gas component concentration-detecting means, the operating error-determining means detecting the degree of influence, based on the air-fuel ratio control amount calculated by the air-fuel ratio control amount-calculating means when the flow rate of the evaporative fuel is changed by the operating error-determining means in the predetermined operating condition of the engine.

Further preferably, the correcting means calculates a learned value of the determined operating error and corrects the control amount of the purge control valve, according to the calculated learned value.

Preferably, the purge control valve is a duty ratio control type electromagnetic valve, the operating error being determined based on a duty ratio assumed when the flow rate of evaporative fuel flowing through the purge control valve is substantially equal to zero.

Preferably, the predetermined operating condition of the engine is a condition where an operating condition of the engine is stable, purging is being carried out by the purge control valve, and at the same time the control of the air-fuel ratio of the mixture in the feedback manner is being carried out by the air-fuel ratio control amount-calculating means.

In a preferred embodiment of the invention, the evaporative fuel control system comprises:

- a canister for adsorbing evaporative fuel generated in the fuel tank;
- a purging passage extending between the canister and the intake system, for purging evaporative fuel into the intake system at a location downstream of the throttle valve;
- a purge control valve arranged across the purging passage, for controlling a flow rate of evaporative fuel supplied to the intake system through the purging passage; and
- operating error-determining means including means operable when the engine is in a predetermined operating condition, for calculating a first air-fuel ratio influence degree parameter indicative of a degree of influence of the evaporative fuel on an air-fuel ratio of a mixture supplied to the engine, means for changing the flow rate of the evaporative fuel at a predetermined ratio by controlling the purge control valve, to thereby calculate a second air-fuel ratio influence degree parameter indicative of the degree of influence of the evaporative fuel on the air-fuel ratio of the mixture after the changing of the flow rate of the evaporative fuel, and means for determining a value of the flow rate of the evaporative fuel assumed when the first and second influence degree parameters indicate that the degree of influence of the evaporative fuel on the air-fuel ratio of the mixture is zero, based on the calculated first and second air-fuel ratio influence degree parameters, and means for determining a control amount of the purge control valve corresponding to the determined value of the flow rate of the evaporative fuel, and determining an operating error of the purge control valve, based on the determined control amount.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
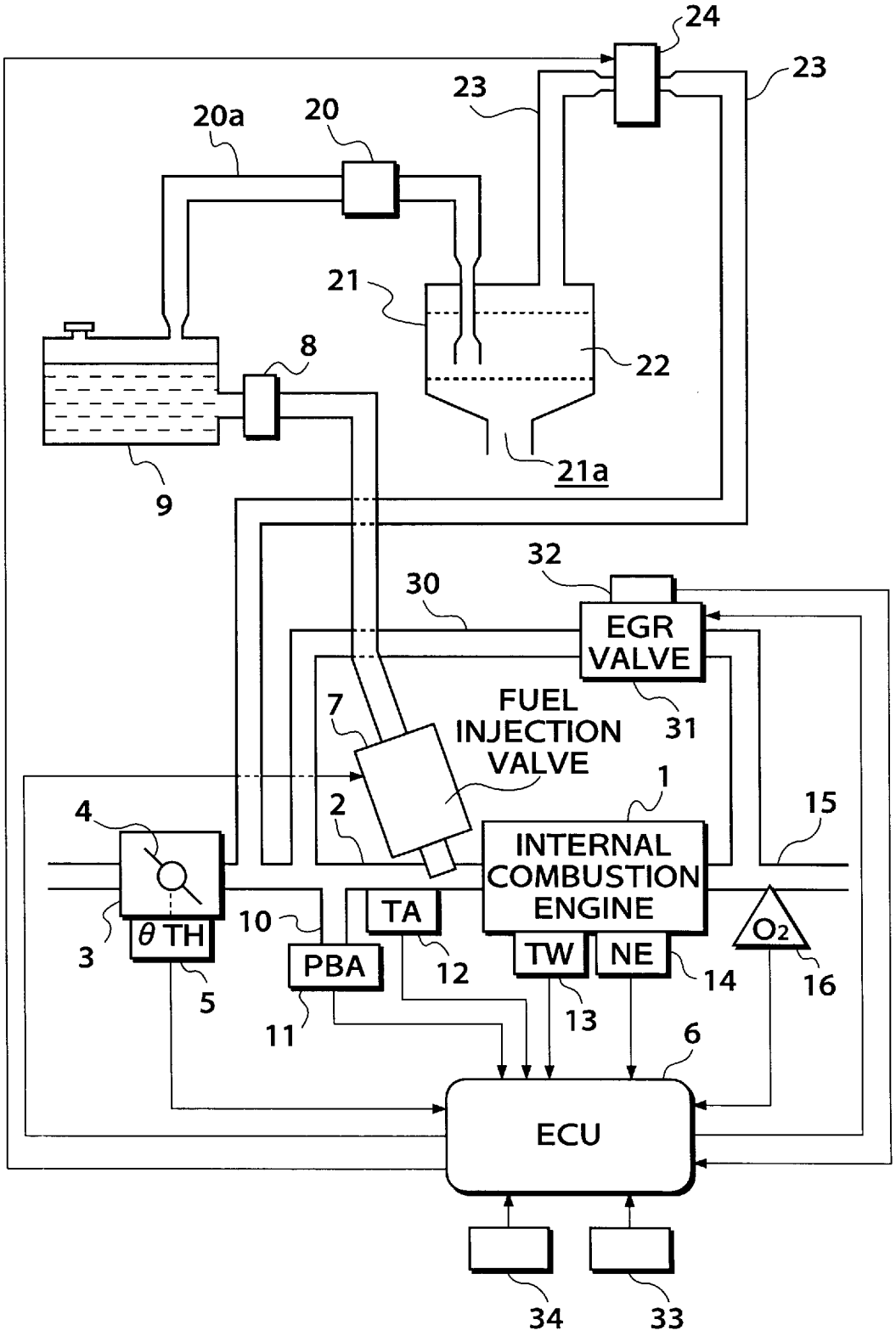
FIG. 1 is a block diagram schematically showing the whole arrangement of an internal combustion engine and an evaporative fuel control system therefor, according to an embodiment of the invention.

Referring first to FIG. 1, there is illustrated the whole arrangement of an internal combustion engine and a control system therefor, according to an embodiment of the invention. In the figure, reference numeral 1 designates an internal combustion engine (hereinafter simply referred to as "the engine") having four cylinders, not shown, for instance. Connected to the cylinder block of the engine 1 is an intake pipe 2, across which is arranged a throttle body 3 accommodating a throttle valve 4 therein. A throttle valve opening (θTH) sensor 5 is connected to the throttle valve 4, for generating an electric signal indicative of the sensed throttle valve opening θTH and supplying the same to an electronic control unit (hereinafter referred to as "the ECU") 6.

Fuel injection valves 7, only one of which is shown, are inserted into the interior of the intake pipe 2 at locations intermediate between the cylinder block of the engine 1 and the throttle valve 4 and slightly upstream of respective intake valves, not shown. The fuel injection valves 7 are connected to a fuel tank 9 via a fuel pump 8. The fuel injection valves 7 are electrically connected to the ECU 6 to have their valve opening periods controlled by signals therefrom.

An intake pipe absolute pressure (PBA) sensor 11 is inserted into the intake pipe 2 at a location immediately downstream of the throttle valve 4 via a conduit 10, for supplying an electric signal indicative of the sensed intake pipe absolute pressure PBA to the ECU 6.

Further, an intake air (TA) sensor 12 is arranged in the intake pipe 2 at a location downstream of the PBA sensor 11, for supplying an electric signal indicative of the sensed intake air temperature TA to the ECU 6. An engine coolant temperature (TW) sensor 13 formed of a thermistor or the like is inserted into a coolant passage formed in the cylinder block, for supplying an electric signal indicative of the sensed engine coolant temperature TW to the ECU 6.

An engine rotational speed (NE) sensor 14 is arranged in facing relation to a camshaft or a crankshaft of the engine 1, neither of which is shown. The NE sensor 14 generates a signal pulse as a TDC signal pulse at each of predetermined crank angles whenever the crankshaft rotates through 180 degrees, the TDC signal pulse being supplied to the ECU 6.

An 02 sensor 16 as an exhaust gas component concentration sensor is arranged in an exhaust pipe 15 of the engine 1, for detecting the concentration of oxygen present in exhaust gases, and generating a signal indicative of the sensed oxygen concentration to the ECU 6. Further electrically connected to the ECU 6 are an atmospheric pressure sensor 33 for detecting the atmospheric pressure PA, and a voltage sensor 34 for detecting output voltage VB from a battery for supplying electric power to the ECU 6, a purge control valve 24, etc., of which respective output signals indicative of the sensed parameter values are supplied to the ECU 6.

The fuel tank 9 which is hermetically sealed has an upper internal space thereof connected to the canister 21 via a passage 20a. The canister 21 communicates with the intake pipe 2 at a location downstream of the throttle valve 4, via a purging passage 23. The canister 21 accommodates therein an adsorbent 22 for adsorbing evaporative fuel generated in the fuel tank 9, and has an air inlet port 21*a*. Arranged across the passage 20*a* is a two-way valve 20 consisting of a positive pressure valve and a negative pressure valve. Further, arranged across the purging passage 23 is a purge control valve 24 which is a duty ratio control type electromagnetic valve. The purge control valve 24 has a solenoid thereof electrically connected to the ECU 6 to have a valve-opening period (valve-opening duty ratio) thereof controlled by a signal therefrom. The passage 20*a*, the two-way valve 20, the canister 21, the purging passage 23, and the purge control valve 24 collectively form an evaporative emission control system.

The evaporative emission control system operates such that evaporative fuel generated in the fuel tank 9 forcibly opens the positive pressure valve of the two-way valve 20 when the pressure thereof has reached a predetermined value, and then flows into the canister 21 to be adsorbed by the adsorbent 22 and stored in the canister 21. The purge control valve 24 is opened and closed in response to a duty ratio control signal from the ECU 6. While the valve 24 is open, evaporative fuel temporarily stored in the canister 21 is drawn through the purge control valve 24 into the intake pipe 21 together with fresh air introduced through the air inlet port 21*a* of the canister 21, due to negative pressure prevailing in the intake pipe 2, and then delivered to the cylinders. On the other hand, if negative pressure within the fuel tank 9 increases as the fuel tank 9 is cooled by fresh air, etc., the negative pressure valve of the two-way valve 20 is opened and hence evaporative fuel temporarily stored in the canister 21 is returned to the fuel tank 9. Thus, evaporative fuel generated in the fuel tank 9 is prevented from being emitted into the atmosphere.

An exhaust gas recirculation passage 30 extends from the intake pipe 2 at a location downstream of the throttle valve 4 to the exhaust pipe 15, across which is arranged an exhaust gas recirculation control (EGR) valve 31 for controlling an amount of exhaust gases to be recirculated.

The EGR valve 31 is an electromagnetic valve having a solenoid which is electrically connected to the ECU 6 to have its valve opening controlled by a signal from the ECU 6. The EGR valve 31 is provided with a lift sensor 32 for detecting the opening of the EGR valve 31 and supplying an electric signal indicative of the sensed value to the ECU 6.

The ECU 6 determines operating conditions of the engine 1, based on engine operating parameter signals from various sensors including ones mentioned above, and supplies a control signal to the solenoid of the EGR valve 31 such that the difference between a valve opening command value LCMD for the EGR valve 31, and an actual valve opening LACT of the EGR valve 31 detected by lift sensor 31 becomes zero. The valve opening command value LCMD is determined based on the intake pipe absolute pressure PBA and the engine rotational speed NE.

The ECU 6 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the fuel injection valves 7, the purge control valve 24, and the EGR valve 31, etc.

The CPU of the ECU 6 operates in response to the above-mentioned various engine operating parameter signals from the various sensors to determine operating conditions in which the engine 1 is operating, such as an air-fuel ratio feedback control region where the air-fuel ratio is controlled to a stoichiometric value, in response to the O2 sensor 16, and air-fuel ratio open-loop control regions, and calculates, based upon the determined engine operating conditions, fuel injection periods TOUT of the fuel injection valves 7, the valve opening duty ratio of the purge control valve 24, and the valve-opening command value LCMD of the EGR valve 31.

Fuel injection from each of the fuel injection valves 7 is carried out in synchronism with generation of TDC signal pulses, and the fuel injection period TOUT is calculated by the use of the following equation (1):

$$TOUT=TI\times KO2\times KPA\times KEGR\times KEVAP\times K1+K2 \quad (1)$$

where TI represents a basic value of the fuel injection period TOUT of the fuel injection valve 7, which is determined according to the engine rotational speed NE and the intake pipe absolute pressure PBA. A TI map for determining the TI value is stored in the memory circuit of the ECU 6

KO2 represents an air-fuel ratio correction coefficient which is determined based on an output value from the 02 sensor 16 when the engine 1 is operating in the air-fuel ratio feedback control region, while it is set to predetermined values corresponding to the respective operating regions of the engine when the engine 1 is in the air-fuel ratio open-loop control regions.

KPA represents an atmospheric pressure-dependent correction coefficient which is set based on the detected atmospheric pressure PA. KEGR represents an EGR-dependent correction coefficient which is set based on the amount of exhaust gases to be recirculated during execution of exhaust gas recirculation.

KEVAP represents an evaporation-dependent correction coefficient which compensates for the influence of purged evaporative fuel, which is set to 1.0 when purging is not effected, while it is set to a value between 0 and 1.0 depending on the air-fuel ratio correction coefficient KO2 during execution of purging. As the KEVAP value is larger, it means that the influence of purging is larger.

K1 and K2 represent other correction coefficients and correction variables, respectively, which are set according to engine operating parameters to such values as optimize engine operating characteristics, such as fuel consumption and engine accelerability.

The CPU of the ECU 6 outputs signals based on the calculations mentioned above, for driving the fuel injection valves 7, the purge control valve 24, and the EGR valve 31, via the output circuit of the ECU 6.

Figure 2:
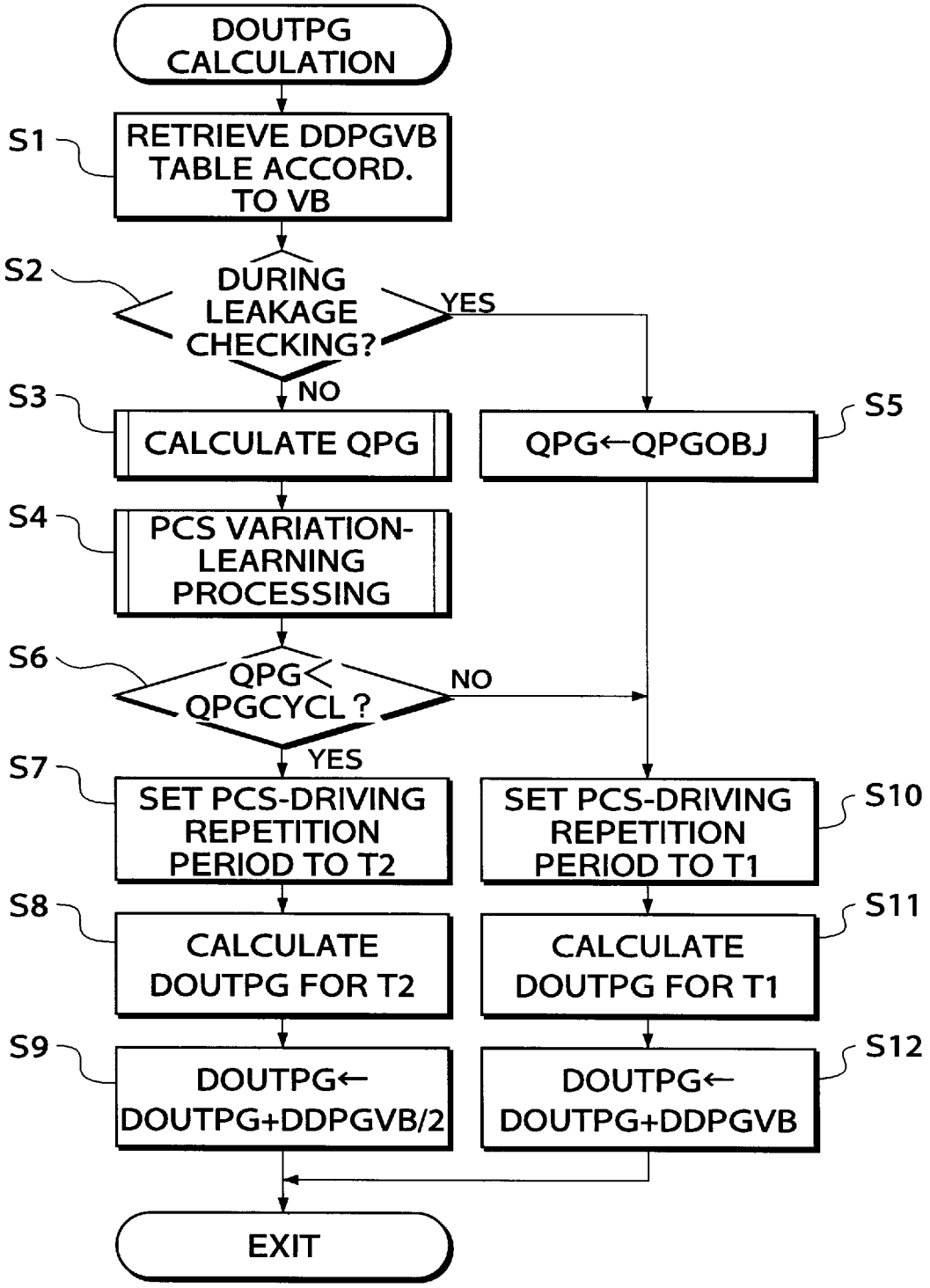
FIG. 2 is a flowchart showing a main routine for calculating a valve-opening duty ratio DOUTPG of a purge control valve appearing in FIG. 2.

FIG. 2 shows a main routine for calculating a valve-opening duty ratio DOUTPG of the purge control valve 24, which is executed at predetermined time intervals (e.g. 80 msec).

Figure 5A:
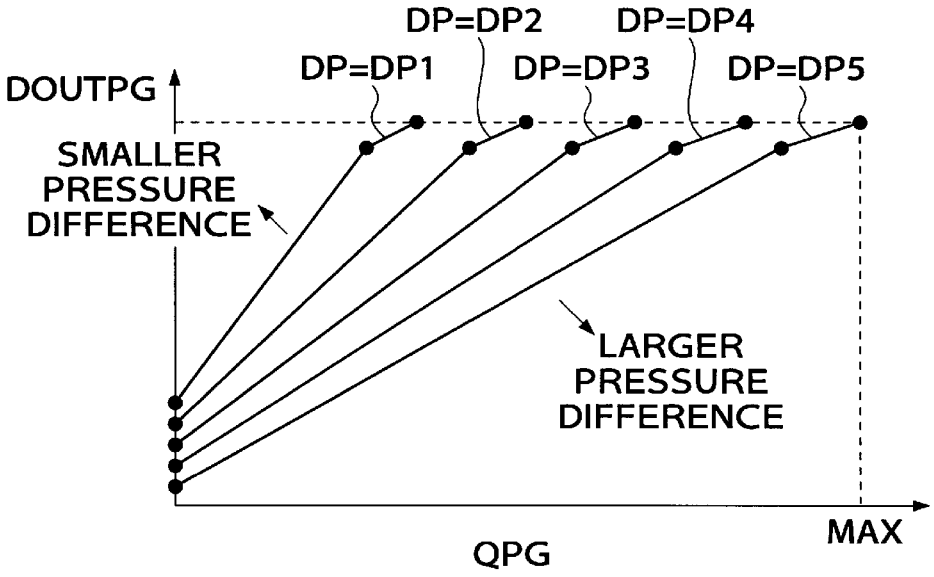
FIG. 5A shows a QPG-DOUTPG table for determining the DOUTPG value, which is used in the FIG. 2 processing.
Figure 5B:
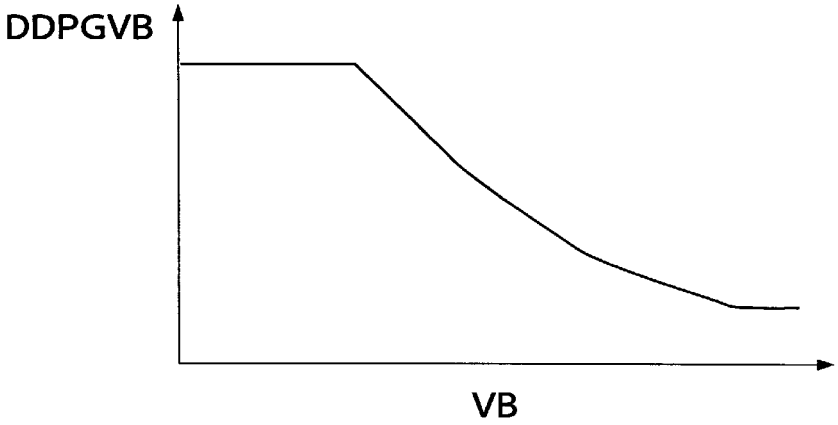
FIG. 5B shows a VB-DDPGVB table for determining a battery voltage correction term DDPGVB.

First, at a step S1, a DDPGVB table shown in FIG. 5B is retrieved according to the battery voltage VB, to determine a battery voltage correction term DDPGVB. The battery voltage correction term DDPGVB is used to correct the valve-opening duty ratio DOUTPG at a step S9 or S12, referred to hereinbelow. At the following step S2, it is determined whether or not leakage-checking of the evaporative emission control system is being carried out. If the leakage-checking is not being carried out, a desired flow rate QPG of evaporative fuel is calculated at a step S3. More specifically, the QPG value is calculated in the following manner:

First, a basic value QPGBASE of the desired flow rate QPG is calculated by the use of the following equation (2):

$$QPGBASE=KQPG\times TI\times KPA\times KEGR\times NE \quad (2)$$

where TI, KPA and KEGR are identical, respectively, with the basic fuel injection amount, the atmospheric pressure-dependent correction coefficient, and the evaporation-dependent correction coefficient in the above equation (1), and KQPG a predetermined coefficient for converting the fuel injection amount into the desired flow rate. Thus, the basic value QPGBASE of the desired flow rate QPG is proportional to the fuel injection amount supplied to the engine per unit time period. The desired flow rate QPG is calculated by correcting the basic value QPGBASE according to an average value of the air-fuel ratio correction coefficient KO2, the intake air temperature TA, etc.

If it is determined that the leakage-checking is being carried out at the step S2, the desired flow rate QPG is set to a predetermined value QPGOBJ at a step S5, followed by the program proceeding to a step S10.

Figure 3:
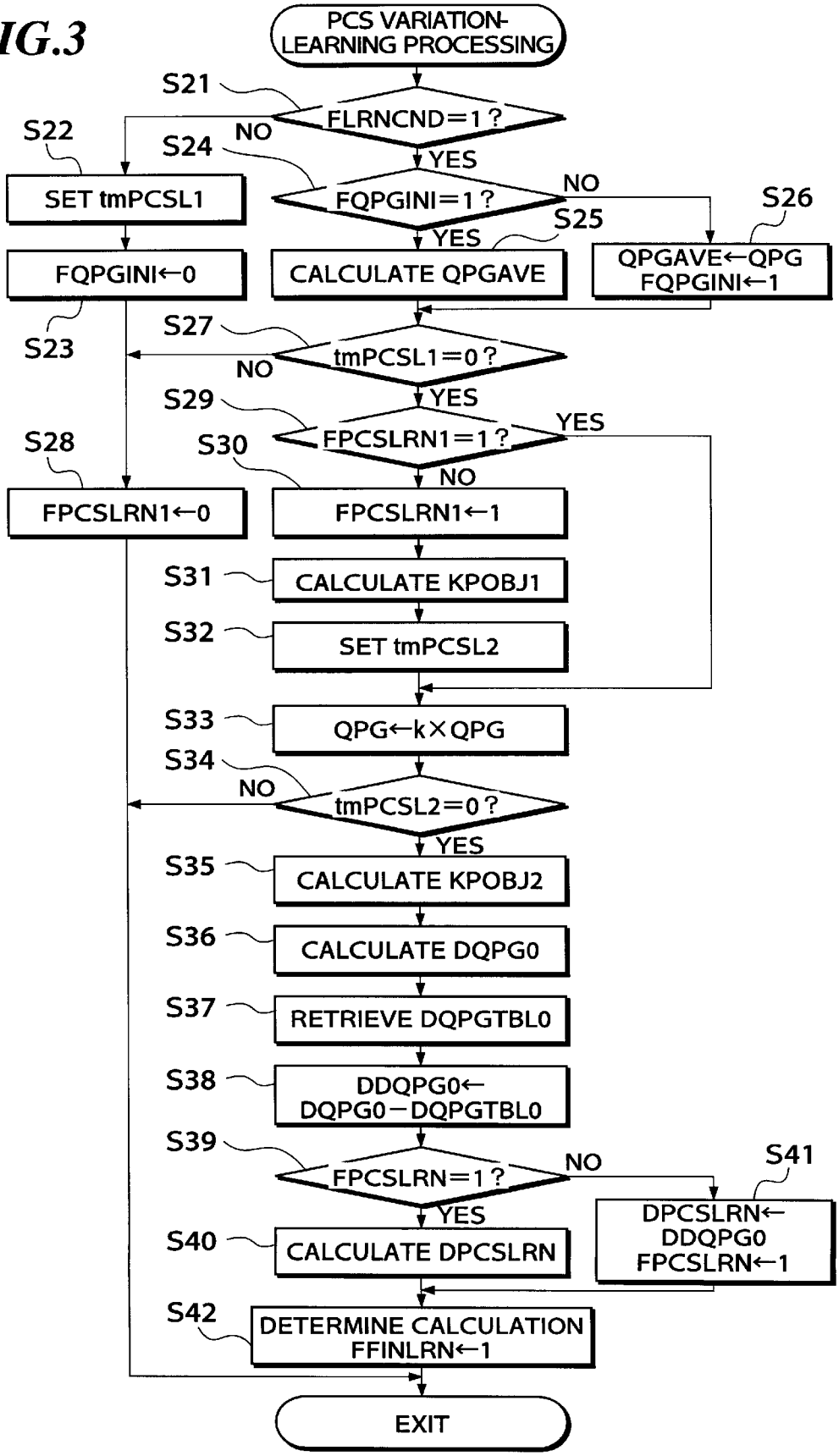
FIG. 3 is a flowchart showing a subroutine for learning variations in characteristics of the purge control valve.

At a step S4, processing for learning variations in characteristics of the purge control valve 24 (hereinafter referred to as "the PCS variation-learning processing") is executed, which will now be described with reference to a subroutine of FIG. 3.

First, at a step S21, it is determined whether or not a learning permission flag FLRNCND which, when set to "1", indicates that execution of the PCS variation-learning processing is permitted, is equal to "1". The learning permission flag FLRNCND is set by executing learning condition-determining processing, referred to hereinafter with reference to FIG. 8.

If it is determined at the step S21 that FLRNCND =0 holds, which means that the learning is not permitted, a down-counting timer tmPCSL1 is set to a first predetermined time period TPCSL1 (e.g. 4 sec) and started at a step S22, and an initialization flag FQPGINI which, when set to "1", indicates that an average value QPGAVE of the desired flow rate QPG has been initialized, is set to "0" at a step S23. Then, at a step S28, a first learning flag FPCSLRN1 which, when set to "1", indicates that a first air-fuel ratio influence degree parameter KPOBJ1, referred to hereinbelow, has been calculated, is set to "0", followed by terminating the present routine.

If FLRNCND=1 holds at the step S21, which means that the learning is permitted, then it is determined at a step S24 whether or not the initialization flag FQPGINI is equal to "1". When this question is first made, FQPGINI=0 holds, and then the program proceeds to a step S26, wherein the initialization is carried out, i.e. the average value QPGAVE of the desired flow rate QPG is set to the desired flow rate QPG, and the initialization flag FQPGINI is set to "1", followed by the program proceeding to a step S27. On the other hand, if FQPGINI=1 holds at the step S24, the average value QPGAVE is calculated at a step S25, by the use of the following equation (3):

$$QPGAVE=C1\times QPG+(1-C1)\times QPGAVE \quad (3)$$

where C1 represents a coefficient set to a value between 0 and 1, and QPGAVE on the right side the average value calculated in the last loop of execution of the step S25.

At the step S27, it is determined whether or not the count value of the timer tmPCSL1 started at the step S22 is equal to "0". If tmPCSL1>0 holds, the program proceeds to the step S28, whereas if tmPCSL1=0 holds, the program proceeds to a step S29. At the step S29, it is determined whether or not the first learning flag FPCSLRN1 is equal to "1". When this question is first made, FPCSLRN1=0 holds, and then the program proceeds to a step S30, wherein the flag FPCSLRN1 is set to "1". Then, the first air-fuel ratio influence degree parameter value KPOBJ1 is calculated at a step S31, by the use of the following equation (4):

$$KPOBJ1=1.0-KEVAP\times KO2PG/KO2PGLRN \quad (4)$$

where KEVAP is identical with the evaporation-dependent correction coefficient in the equation (1), KO2PG an average value of the air-fuel ratio correction coefficient KO2 calculated by the use of the following equation (5), and KO2PGLRN an average value of the average value KO2PG, calculated by processing of FIG. 9, referred to hereinafter, by the use of the following equation (6). The KO2PG value and the KO2PGLRN value will be referred to as "the first average value" and "the second average value", respectively, hereinbelow:

$$KO2PG=C2\times KO2P+(1-C2)\times KO2PG \quad (5)$$

$$KO2PGLRN=C3\times KO2PG+(1-C3)\times KO2PGLRN \quad (6)$$

where C2 and C3 represent coefficients each set to a value between 0 and 1, KO2P represents a value of the KO2 value obtained when a proportional term is generated during execution of the air-fuel ratio feedback control (immediately after an inversion of the output value from the 02 sensor 16 with respect to the stoichiometric value), KO2PG on the right side of the equation (5) a last calculated value of the first average value KO2PG, KO2PG on the right side of the equation (6) a present value of the first average value KO2PG, and KO2PGLRN on the right side of the equation (6) a last calculated value of the second average value KO2PGLRN. The second average value KO2PGLRN is calculated, as indicated at a step S73 in FIG. 9, hereinafter referred to, when the valve-opening duty ratio DOUTPG is equal to 0, i.e. when purging is not carried out. As the influence degree of purging increases, the evaporation-dependent correction coefficient KEVAP and the first average value KO2PG both decrease, and accordingly the air-fuel ratio influence degree parameter KPOBJ calculated by the above equation (4) increases. On the other hand, if the influence degree of purging decreases, the KEVAP value and the KO2PG value both become closer to 1.0, and accordingly the air-fuel ratio influence degree parameter KPOBJ decreases. If purging is not carried out, the KPOBJ value becomes equal to 0.

Then, a down-counting timer tmPCSL2 is set to a second predetermined time period TMPCSL2 (e.g. 7 sec) and started at a step S32, followed by the program proceeding to a step S33. After the first learning flag FPCSLRN1 is set to "1" at the step S29, the program jumps to the step S33.

At the step S33, the desired flow rate QPG is multiplied by a predetermined value k (e.g. 0.5) to obtain a new value of the desired flow rate QPG, and then it is determined at a step S34 whether or not the value of the timer tmPCSL2 started at the step S32 is equal to "0". If tmPCSL2>0 holds, the program is immediately terminated, whereas if tmPCSL2=0 holds, a second air-fuel ratio influence degree parameter KPOBJ2 is calculated at a step S35, by the use of the following equation (7):

$$KPOBJ2=1.0-KEVAP\times KO2PG/KO2PGLRN \quad (7)$$

where the whole right side of the equation (7) is identical with that of the equation (4).

At the following step S36, a zero-influence desired flow rate QPG0 at which the air-fuel ratio influence degree parameter KPOBJ becomes equal to 0, by the use of the following equation (8)

$$QPG0=(KPOBJ1\times k-KPOBJ2)/(KPOBJ1-KPOBJ2)\times QPGAVE \quad (8)$$

Figure 4A:
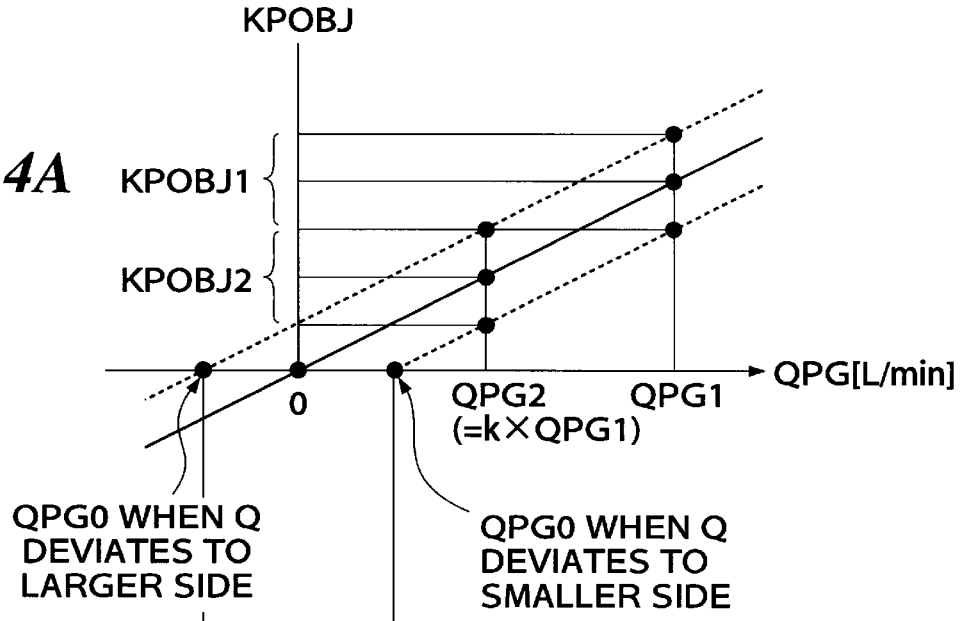
FIG. 4A shows a QPG-KPOBJ table for determining an air-fuel ratio influence degree parameter KPOBJ, which is used in the FIG. 3 processing.

A manner of obtaining the equation (8) will now be described: The desired flow rate QPG is almost proportional to the air-fuel ratio influence degree parameter KPOBJ, as shown in FIG. 4A, and accordingly the following equation (9) stands:

$$QPG=(QPG1-QPG2)/(KPOBJ1-KPOBJ2)\times KPOBJ+QPG0 \quad (9)$$

where QPG1 represents a value of the desired flow rate QPG obtained when the first air-fuel ratio influence degree parameter KPOBJ1 is calculated. Therefore, if the QPG1 value is replaced by the average value QPGAVE of the desired flow rate QPG calculated over the first predetermined time period TPCSL1 from the start of the learning, the QPG2 value by a value k×QPG1=k×QPGAVE, the QPG value by the QPGAVE value, and the KPOBJ value by the KPOBJ1 value, the QPG0 value can be obtained by the equation (8). As is clear from FIG. 4A, when a flow rate Q of evaporative fuel deviates to a larger side due to variations in characteristics, the QPG0 value assumes a negative value.

Figure 4B:
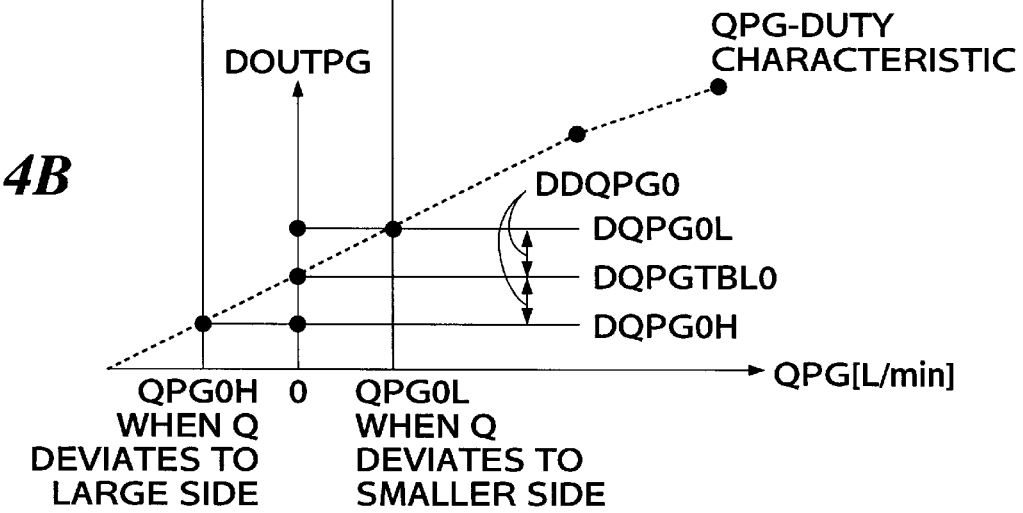
FIG. 4B shows a QPG-DOUTPG table for converting a desired flow rate QPG into a valve-opening duty ratio DOUTPG, which is used in the FIG. 3 processing.

Next, a zero-influence valve-opening duty ratio DQPG0 is calculated from a QPG-DOUTPG table for converting the desired flow rate QPG to a valve-opening duty ratio DOUTPG. More specifically, as shown in FIG. 4B, if the zero-influence desired flow rate QPG0 assumed when the actual flow rate Q deviates to a smaller side is designated by QPG0L, the valve-opening duty ratio DOUTPG corresponding thereto is designated by DQPG0L. On the other hand, if the zero-influence desired flow rate QPG0 assumed when the actual flow rate Q deviates to the larger side is designated by QPG0H, which is a negative value not included in the QPG-DOUTPG table, and therefore the zero-influence valve-opening duty ratio DQPG0H is determined from an extension of a line indicative of the conversion characteristic from set values in the table as indicated by the broken line in FIG. 4B.

At the following step S37, a mean valve-opening duty ratio DQPGTBL0 assumed when the desired flow rate QPG is equal to 0 (see FIG. 4B) is retrieved from the QPG—DOUTPG table. Then, an operating error DDQPG0 is calculated at a step S38, by the use of the following equation (10):

$$DDQPG0=DQPG0-DQPGTBL0 \quad (10)$$

As is clear from FIG. 4B, if the actual flow rate Q deviates to the larger side, the operating error DDQPG0 assumes a negative value.

At the following step S39, it is determined whether or not a second learning flag FPCSLRN which, when set to "1", indicates that initialization of a learned value DPCSLRN has been completed, is equal to "1". When this question is first made, FPCSLRN=0 holds, and then the program proceeds to a step S41, wherein the learned value DPCSLRN is set to the operating error DDQPG0 calculated at the step S38 and the second learning flag FPCSLRN is set to "1", followed by the program proceeding to a step S42. Thereafter, the answer to the question of the step S39 becomes affirmative (YES), and then the program proceeds to a step S40, wherein the learned value DPCSLRN is calculated by the use of the following equation (11), followed by the program proceeding to the step S42:

$$DPCSLRN=C4\times DDQPG0+(1-C4)\times DPCSLRN \quad (11)$$

where C4 represents a constant set to a value between 0 and 1, and DPCSLRN on the right side a last calculated value of the DPCSLRN value.

The thus calculated learned value DPCSLRN is stored in a RAM of the memory circuit of the ECU 6 which is backed-up by the battery even when an ignition switch of the engine is off.

At the step S42, a learning completion flag FFINLRN which, when set to "1", indicates that the calculation of the learned value DPCSLRN has been completed, is set to "1", followed by terminating the present routine.

As described hereinabove, in the FIG. 3 processing, while the engine is operating in a condition where the learning conditions are satisfied, the desired purging flow rate is changed between two different values, and the learned value DPCSLRN, which is an average value of the operating error DDQPG0 of the purge control valve 24, is calculated based on the air-fuel ratio influence degree parameters KPOBJ1 and KOBJ2 obtained before and after the change of the desired purging flow rate. As a result, influences of factors other than the purging can be eliminated in measuring the operating error to thereby obtain a correct operating error.

Referring again to FIG. 2, it is determined at a step S6 whether or not the desired flow rate QPG is smaller than a predetermined value QPGCYCL. If QPG≧QPGCYCL holds, the repetition period of generation of the driving signal for driving the purge control valve 24 is set to a first value T1 (e.g. 80 msec) at a step S10, and then a value of the valve-opening duty ratio DOUTPG for the first repetition period value T1 is calculated at a step S11. More specifically, a DOUTPG table of FIG. 5A is retrieved according to the desired flow rate QPG, to determine the valve-opening duty ratio DOUTPG. A plurality of kinked lines in FIG. 5A indicate DOUTPG values assumed, respectively, when a pressure difference DP (=PA−PBA) between the atmospheric pressure PA and the intake pipe absolute pressure PBA assumes values DP1, DP2, DP3, DP4, and DP5. In the table, an upper side kinked line is employed as the pressure difference is smaller. That is, a relationship of DP1<DP2<DP3<DP4<DP5 holds. This is because the smaller the pressure difference DP, the larger the valve-opening duty ratio DOUTPG required for obtaining the same flow rate. If the pressure difference DP is not equal to any of the DP1 to DP5 values, interpolation is carried out to determine the DOUTPG value.

Figure 6:
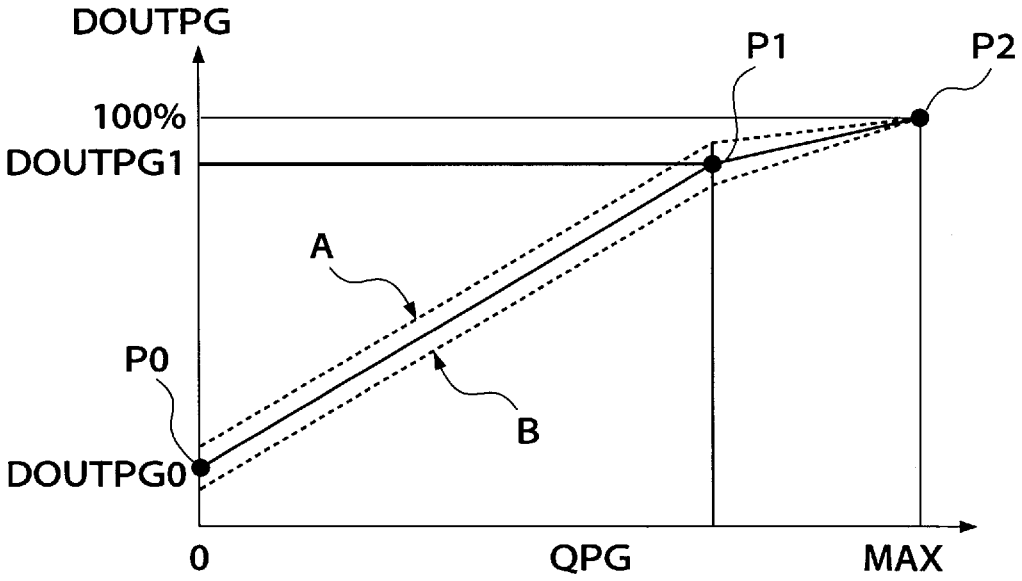
FIG. 6 is a graph useful in explaining a manner of correcting the DOUTPG value.

The calculation of the DOUTPG value is carried out by correcting the DOUTPG value set in the table of FIG. 5A corresponding to the DP value by the learned value DPCSLRN calculated at the step S4. More specifically, the kinked lines in the table of FIG. 5A are each defined by three points P0, P1, and P2 as shown in FIG. 6, and the correction is made by vertically moving the points P0 and P1 according to the learned value DPCSLRN, to thereby determine the valve-opening duty ratio DOUTPG corresponding to the broken line A or B. That is, by adding the learned value DPCSLRN to values DOUTPG0 and DOUTPG1 corresponding, respectively, to the points P0 and P1, the set value in the table is corrected to thereby finally determine the DOUTPG value.

The point P2 is not moved by the following reason: In the present embodiment, the operating error due to a variation in the time lag of the operation of the purge control valve 24 is corrected by the learned value DPCSLRN. When the valve-opening duty ratio DOUTPG is equal to 100%, however, the valve operation is not affected by the time lag of the operation.

Figure 7A:
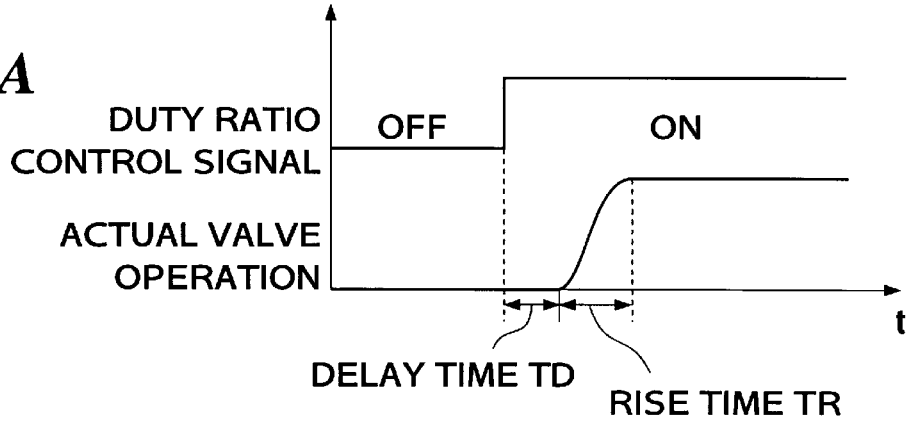
FIG. 7A is a graph useful in explaining an operating time lag of the purge control valve.
Figure 7B:
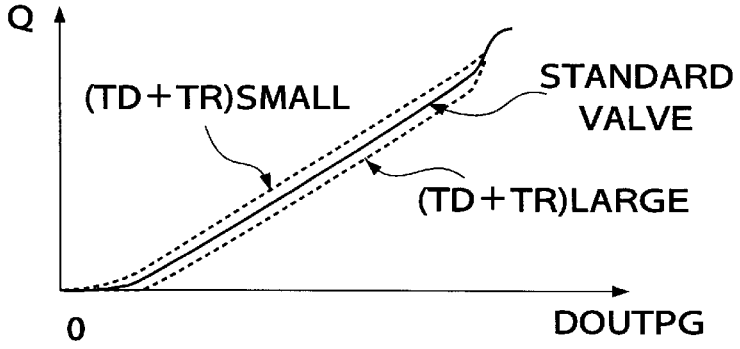
FIG. 7B is a graph useful in explaining the relationship between a flow rate Q of evaporative fuel and manufacturing tolerances of the purge control valve.

More specifically, when the duty ratio control signal is turned from an off state to an on state, as shown in FIG. 7A, the actual valve operation starts after an operating time lag (TD+TR) consisting of a delay time TD from the issuance of the signal to the actual start of opening of the valve 24, and a rise time TR of opening thereof. The operating time lag TD varies due to manufacturing tolerances such that the evaporative fuel flow rate Q varies with the same valve-opening duty ratio DOUTPG, as shown in FIG. 7B. Therefore, by correcting the points P0 and P1 as shown in FIG. 6, the operating error due to variations in the operating time lag can be corrected.

Thus, the DOUTPG table is corrected to calculate the valve-opening duty ratio DOUTPG, based on the learned value DPCSLRN corresponding to the operating error of the purge control valve 24, calculated at the step S4 in FIG. 2. As a result, the influence of the operating error due to variations in characteristics of the purge control valve 24 can be compensated for, to thereby enable controlling the flow rate of evaporative fuel with high accuracy.

Referring again to FIG. 2, at the following step S12, the battery voltage correction term DDPGVB calculated at the step S1 is used to correct the battery voltage of the valve-opening duty ratio DOUTPG, by the use of the following equation (12), followed by terminating the present routine:

$$DOUTPG=DOUTPG+DDPGVB \quad (12)$$

On the other hand, if QPG<QPGCYCL holds at the step S6, which means that the desired flow rate QPG is small, the repetition period of generation of the driving signal for driving the purge control valve 24 is set to a second value T2 which is twice as large as the first value T1 at a step S7, and then the valve-opening duty ratio DOUTPG for the second repetition period value T2 is calculated at a step S8. More specifically, the desired flow rate QPG is doubled, according to which the DOUTPG table of FIG. 5 is retrieved, and a half of the thus retrieved value is set to the valve-opening duty ratio DOUTPG. On this occasion, the valve-opening duty ratio is corrected by the learned value DPCSLRN in a manner similar to the manner described above at the step S11. At the following step S9, the valve-opening duty ratio DOUTPG is corrected based on the battery voltage correction term DDPGVB calculated at the step S1, by the use of the following equation (13), followed by terminating the present routine:

$$DOUTPG=DOUTPG+DDPGVB/2 \quad (13)$$

The reason why the battery correction term DDPGVB is set to a half thereof is that when the repetition period of generation of the driving signal for the purge control valve is doubled, the time period over which the signal is on is doubled, which halves the influence of the battery voltage VB.

Figure 8:
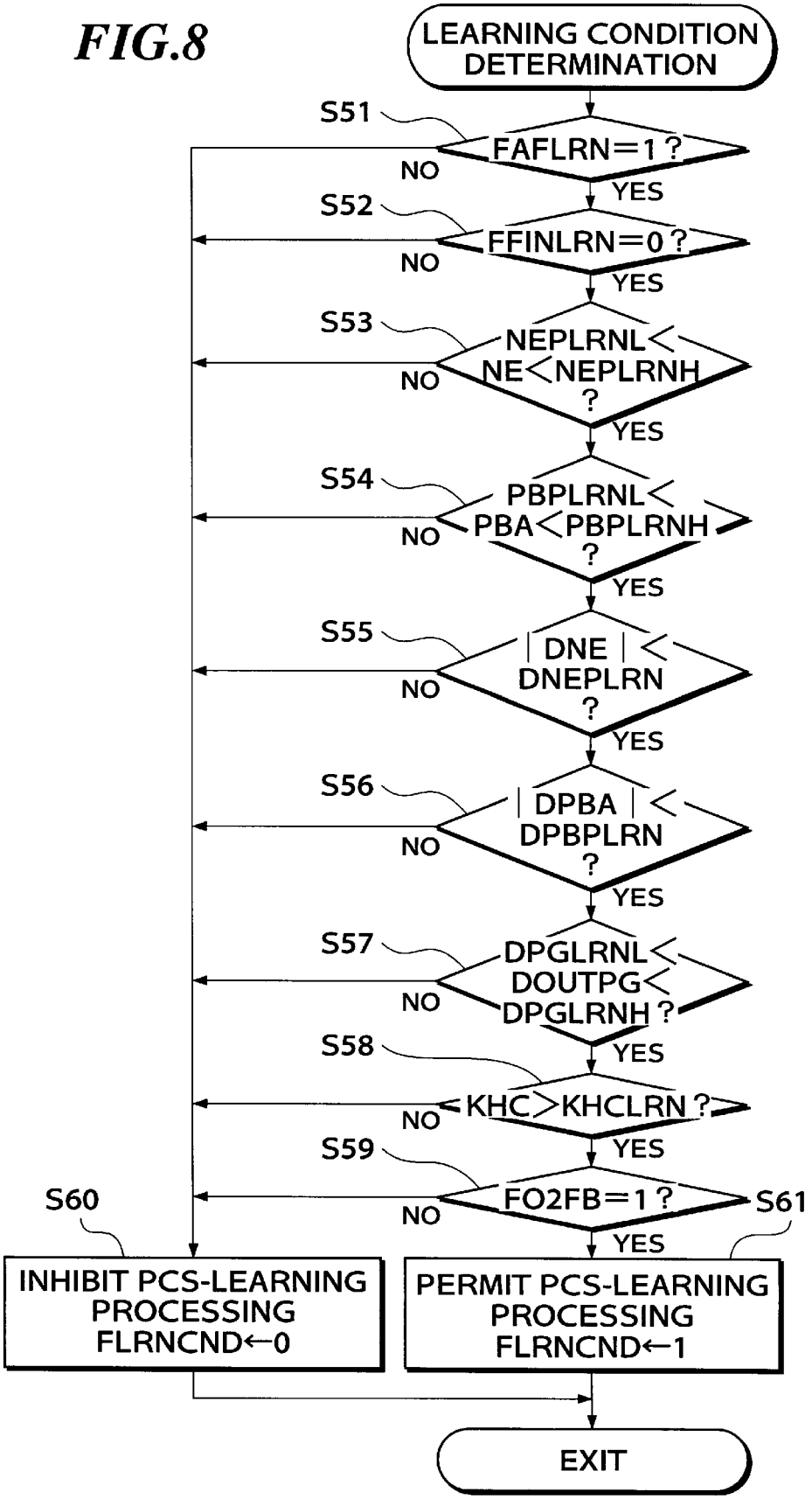
FIG. 8 is a flowchart showing a subroutine for carrying out learning condition-determining processing, which is executed at a step S21 in FIG. 3.

FIG. 8 shows a subroutine for carrying out the learning condition-determining processing for determining the PCS variation-learning conditions, which is executed in synchronism with generation of TDC signal pulses.

First, at a step S51, it is determined whether or not an AF-learning flag FAFLRN (see a step S79 in FIG. 9) which, when set to "1", indicates that the second average value KO2PGLRN has been calculated, is equal to "1". If FAFLRN=1 holds, it is determined at a step S52 whether or not the learning completion flag FFINLRN is equal to "0". If FFINLRN=0 holds, which means that the learned value DPCSLRN has not been calculated yet, it is determined at a step S53 whether or not the engine rotational speed NE falls within a range between a predetermined upper limit value NEPLRNH (e.g. 2500 rpm) and a predetermined lower limit value NEPLRNL (e.g. 1500 rpm). If NEPLRNL<NE<NEPLRNH holds, then it is determined at a step S54 whether or not the intake pipe absolute pressure PBA falls within a range between a predetermined upper limit value PBPLRNH (e.g. 410 mmHg) and a predetermined lower limit value PBPLRNL (e.g. 310 mmHg). If PBPLRNL<PBA<PBPLRNH holds, then it is determined at a step S55 whether or not the absolute value of a rate of change DNE (=NE (present value)—NE (last value)) in the engine rotational speed NE is smaller than a predetermined value DNEPLRN (e.g. 30 rpm). If |DNE|<DNEPLRN holds, then it is determined at a step S56 whether or not the absolute value of a rate of change DPBA (=PBA (present value)—PBA (last value)) in the intake pipe absolute pressure PBA is smaller than a predetermined value DPBPLRN (e.g. 20 mmHg).

If |DPBA|<DPBPLRN holds, the program proceeds to a step S57. On the other hand, if any of the answers to the questions of the steps S51 to S56 is negative (NO), it is determined that the PSC variation-learning conditions are not satisfied, and then the learning permission flag FLRNCND is set to "0" at a step S60, followed by terminating the present routine.

At the step S57, it is determined whether or not the valve-opening duty ratio DOUTPG calculated in the FIG. 2 processing falls within a range between a predetermined upper limit value DPGLRNH (e.g. 95%) and a predetermined lower limit value DPGLRNL (e.g. 60%). If DPGLRNL<DOUTPG<DPGLRNH holds, it is determined at a step S58 whether or not a purged vapor concentration-estimated value KHC is larger than a predetermined value KHCLRN (e.g. 3%). The purged vapor concentration-estimated value KHC is calculated based on the air-fuel ratio correction coefficient KO2 during execution of the air-fuel ratio feedback control.

If KHC≦KHCLRN holds at the step S58, it is determined that the influence of purging upon the air-fuel ratio is so small that the variation learning of the purge control valve 24 should not be carried out. Then, the program proceeds to the step S60, wherein it is determined that the learning conditions are not satisfied. On the other hand, if KHC>KHCLRN holds at the step S58, it is determined at a step S59 whether or not a feedback flag FO2FB which, when set to "1", indicates that the air-fuel ratio feedback control is being carried out, is equal to "1". If FO2FB=0 holds, then the program proceeds to the step S60, whereas if FO2FB=1 holds, which means that the air-fuel ratio feedback control is being carried out, it is determined that the learning conditions are satisfied. Then, the learning permission flag FLRNCND is set to "1" at a step S61, followed by terminating the present routine.

According to the present routine, when the engine operating condition is stable, purging is being carried out to a moderate degree, and at the same time the air-fuel ratio feedback control is carried out, it is determined that the learning conditions are satisfied.

Figure 9:
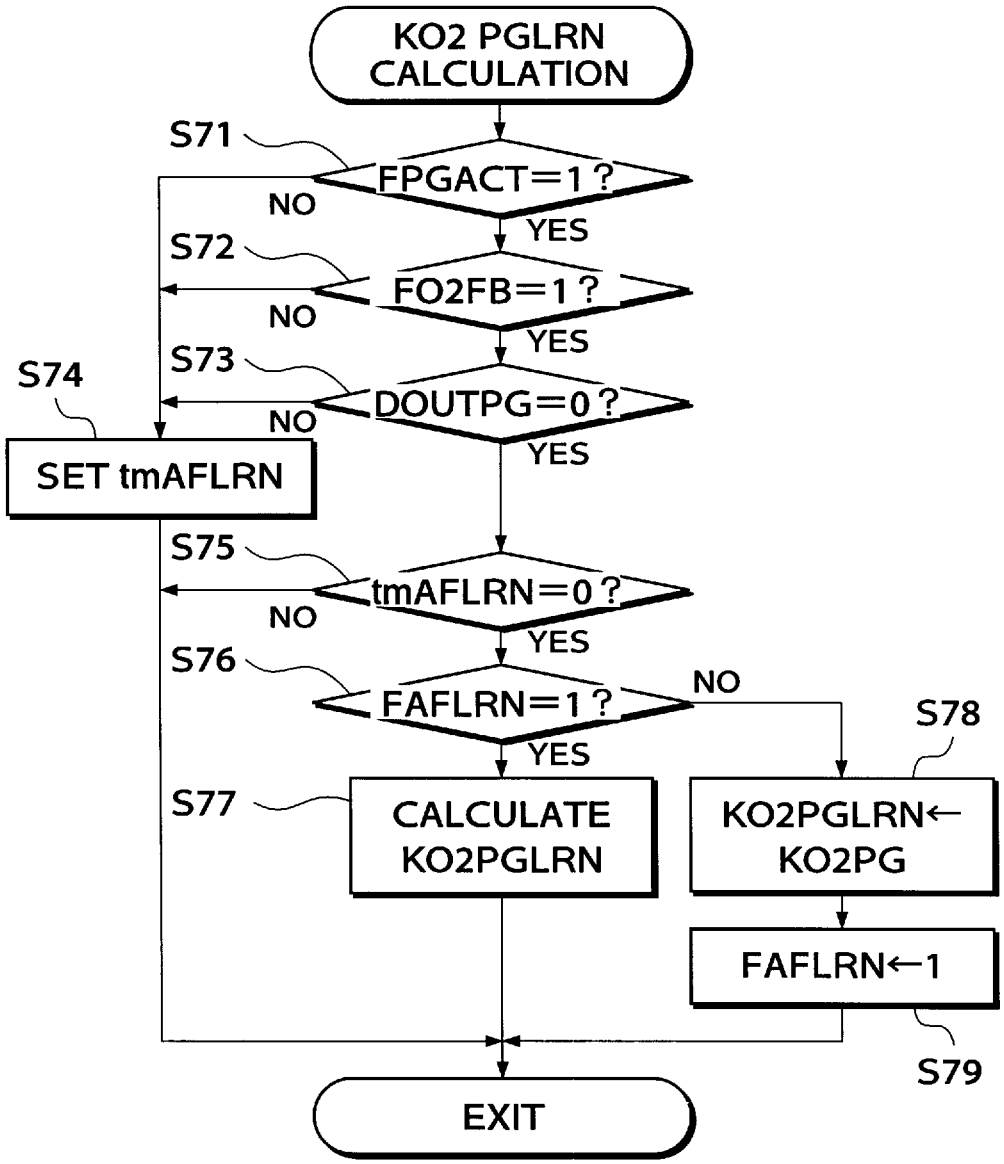
FIG. 9 is a flowchart showing a program for calculating a parameter K02PGLRN used in the subroutine of FIG. 3.

FIG. 9 shows a subroutine for calculating the second average value K02PGLRN, which is executed in synchronism with generation of TDC signal pulses.

First, at a step S71, it is determined whether or not a purge permission flag FPGACT which, when set to "1", indicates that purging can be carried out, is equal to "1". If FPGACT=1 holds, it is determined at a step S72 whether or not the feedback flag FO2FB is equal to "1". If FO2FB=1 holds, it is determined at the step S73 whether or not the valve-opening duty ratio DOUTPG is equal to "0". If any of the answers to the questions of the steps S71 to S73 is negative (NO), a down-counting timer tmAFLRN is set to a predetermined time period TAFLRN and started at a step S74, followed by terminating the present routine.

On the other hand, if DOUTPG=0 holds at the step S73, which means that purging is not being carried out, then it is determined at a step S75 whether or not the count value of the timer tmAFLRN started at the step S74 is equal to 0. If tmAFLRN>0 holds, the program is immediately terminated, whereas if tmAFLRN=0 holds, the program proceeds to a step S76, wherein it is determined whether or not the AF-learning flag FAFLRN is equal to "1". When this question is first made, FAFLRN=0 holds, and then the program proceeds to a step S78, wherein the second average value KO2PGLRN is set to the first average value KO2PG. Then, the AF-learning flag FAFLRN is set to "1" at the step S79, followed by terminating the present routine.

If the AF-learning flag FAFLRN is set to "1", the program proceeds from the step S76 to a step S77, wherein the second average value KO2PGLRN is calculated by the use of the above equation (6), followed by terminating the present routine.

According to the present program, when purging is not carried out even though it is permitted and at the same time the air-fuel ratio feedback control is being carried out, the second average value KO2PGLRN is calculated.

What is claimed is:

1. An evaporative fuel control system for an internal combustion engine having an intake system, a throttle valve arranged in said intake system, and a fuel tank, comprising:

a canister for adsorbing evaporative fuel generated in said fuel tank;

a purging passage extending between said canister and said intake system, for purging evaporative fuel into said intake system at a location downstream of said throttle valve;

a purge control valve arranged across said purging passage, for controlling a flow rate of evaporative fuel supplied to said intake system through said purging passage; and operating error-determining means operable when said engine is in a predetermined stable operating condition, for changing said flow rate of evaporative fuel supplied to said engine by controlling said purge control valve, for detecting a first degree of influence of said evaporative fuel on an air-fuel ratio of a mixture supplied to said engine, and a second degree of influence of the same, respectively before and after said changing of said flow rate of said evaporative fuel, and for determining an operating error of said purge control valve, based on the detected first and second degrees of influence.

2. An evaporative fuel control system as claimed in claim 1, further including correcting means for correcting a control amount of said purge control valve according to said operating error determined by said operating error-determining means.

3. An evaporative fuel control system as claimed in claim 1, wherein said engine has an exhaust system, said operating error-determining means including exhaust gas component concentration-detecting means arranged in said exhaust system, and air-fuel ratio control amount-calculating means for calculating an air-fuel ratio control amount for controlling said air-fuel ratio of said mixture in a feedback manner responsive to an output from said exhaust gas component concentration-detecting means, said operating error-determining means detecting said degree of influence, based on said air-fuel ratio control amount calculated by said air-fuel ratio control amount-calculating means when said flow rate of said evaporative fuel is changed by said operating error-determining means in said predetermined operating condition of said engine.

4. An evaporative fuel control system as claimed in claim 2, wherein said engine has an exhaust system, said operating error-determining means including exhaust gas component concentration-detecting means arranged in said exhaust system, and air-fuel ratio control amount-calculating means for calculating an air-fuel ratio control amount for controlling said air-fuel ratio of said mixture in a feedback manner responsive to an output from said exhaust gas component concentration-detecting means, said operating error-determining means detecting said degree of influence, based on said air-fuel ratio control amount calculated by said air-fuel ratio control amount-calculating means when said flow rate of said evaporative fuel is changed by said operating error-determining means in said predetermined operating condition of said engine.

5. An evaporative fuel control system as claimed in claim 2, wherein said correcting means calculates a learned value of the determined operating error and corrects said control amount of said purge control valve, according to the calculated learned value.

6. An evaporative fuel control system as claimed in claim 2, wherein said purge control valve is a duty ratio control type electromagnetic valve, said operating error being determined based on a duty ratio assumed when said flow rate of evaporative fuel flowing through said purge control valve is substantially equal to zero.

7. An evaporative fuel control system as claimed in claim 3, wherein said predetermined operating condition of said engine is a condition where an operating condition of said engine is stable, purging is being carried out by said purge control valve, and at the same time said control of said air-fuel ratio of said mixture in said feedback manner is being carried out by said air-fuel ratio control amount-calculating means.

8. An evaporative fuel control system for an internal combustion engine having an intake system, a throttle valve arranged in said intake system, and a fuel tank, comprising:

a canister for adsorbing evaporative fuel generated in said fuel tank;

a purging passage extending between said canister and said intake system, for purging evaporative fuel into said intake system at a location downstream of said throttle valve;

a purge control valve arranged across said purging passage, for controlling a flow rate of evaporative fuel supplied to said intake system through said purging passage; and operating error-determining means including means operable when said engine is in a predetermined operating stable condition, for calculating a first air-fuel ratio influence degree parameter indicative of a degree of influence of said evaporative fuel on an air-fuel ratio of a mixture supplied to said engine, means for changing said flow rate of said evaporative fuel at a predetermined ratio by controlling said purge control valve, to therein calculate a second air-fuel ratio influence degree parameter indicative of said degree of influence of said evaporative fuel on said air-fuel ratio of said mixture after said changing of said flow rate of said evaporative fuel, and means for determining a value of said flow rate of said evaporative fuel assumed when said first and second influence degree parameters indicate that said degree of influence of said evaporative fuel on said air-fuel ratio of said mixture is zero, based on the calculated first and second air-fuel ratio influence degree parameters, and means for determining a control amount of said purge control valve corresponding to the determined value of said flow rate of said evaporative fuel, and for determining an operating error of said purge control valve, based on the determined control amount.

9. An evaporative fuel control system as claimed in claim 8, further including correcting means for correcting a control amount of said purge control valve according to said operating error determined by said operating error-determining means.

10. An evaporative fuel control system as claimed in claim 8, wherein said engine has an exhaust system, said operating error-determining means including exhaust gas component concentration-detecting means arranged in said exhaust system, and air-fuel ratio control amount-calculating means for calculating an air-fuel ratio control amount for controlling said air-fuel ratio of said air-fuel mixture in a feedback manner responsive to an output from said exhaust gas component concentration-detecting means, said operating error-determining means detecting said first and second air-fuel ratio influence degree parameters, based on said air-fuel ratio control amount calculated by said air-fuel ratio control amount-calculating means when said flow rate of said evaporative fuel is changed by said operating error-determining means at said predetermined ratio.

11. An evaporative fuel control system as claimed in claim 9, wherein said correcting means calculates a learned value of the determined operating error and corrects said control amount of said purge control valve, according to the calculated learned value.

12. An evaporative fuel control system as claimed in claim 9, wherein said purge control valve is a duty ratio control type electromagnetic valve, said operating error being determined based on a duty ratio assumed when said flow rate of evaporative fuel flowing through said purge control valve is substantially equal to zero.

13. An evaporative fuel control system as claimed in claim 10, wherein said predetermined operating condition of said engine is a condition where an operating condition of said engine is stable, purging is being carried out by said purge control valve, and at the same time said control of said air-fuel ratio of said mixture in said feedback manner is being carried out by said air-fuel ratio control amount-calculating means.

* * * * *